United States Patent [19]

Asakawa

[11] 4,042,279

[45] Aug. 16, 1977

[54] APPARATUS FOR RECOVERING MINERALS, IN PARTICULAR MANGANESE NODULES, FROM THE BOTTOM OF THE WATER

[75] Inventor: Yoshio Asakawa, Koganei, Japan

[73] Assignee: Sumitomo Metal Mining Company Limited, Tokyo, Japan

[21] Appl. No.: 723,180

[22] Filed: Sept. 14, 1976

[30] Foreign Application Priority Data

Oct. 2, 1975 Japan ..... 50-119224

[51] Int. Cl.[2] ..... E02F 3/94

[52] U.S. Cl. ..... 299/8; 37/57; 37/DIG. 8

[58] Field of Search ..... 299/8; 37/57, DIG. 8

[56] References Cited

U.S. PATENT DOCUMENTS

| | | | |
|---|---|---|---|
| 2,144,743 | 1/1939 | Schulz | 299/8 |
| 3,588,174 | 6/1971 | Rossfelder | 299/8 |
| 3,802,740 | 4/1974 | Sullivan | 299/8 |
| 3,975,054 | 8/1976 | Brockett et al. | 37/DIG. 8 |

FOREIGN PATENT DOCUMENTS

| | | | |
|---|---|---|---|
| 692,998 | 8/1964 | Canada | 37/DIG. 8 |

*Primary Examiner*—Ernest R. Purser
*Attorney, Agent, or Firm*—Watson, Cole, Grindle & Watson

[57] ABSTRACT

An apparatus for recovering minerals from the bottom of the water comprising a frame which supports a pump taking in the water and feeding it to nozzles mentioned below, a driving device for the pump, a collection chamber and at least one mineral floating apparatus, which fixed an end of a suction pipe leading to the collection chamber and which is so formed that it can travel on the bottom of the water. The above-mentioned mineral floating apparatus is integrally formed with a cylindrical surface, the nozzle arranged in contact with the cylindrical surface and jetting the water in the direction of a tangent which is at a right angle to the center axis of the cylindrical surface, a plurality of ribs projecting in the opposite direction to the side of the cylindrical surface of the nozzle and extending in the jet direction of the nozzle, and a duct which has an opening at one end of the duct at the downstream of the water jetted from the nozzle and extends slopewise in tangent with a part of the cylindrical surface so as to receive the water moved along the outside of the cylindrical surface. The above-mentioned mineral floating apparatus is so arranged that the side of the cylindrical surface having the nozzle and ribs exposes to the bottom surface of the frame, the jet direction of the nozzle and the direction of the base line of the cylindrical surface go almost parallel to the bottom surface of the frame, and the mineral floating apparatus is supported at the opposite side to the duct by a supporting shaft provided in the frame so as to be able to move the side of the duct up and down by turning the mineral floating apparatus around the supporting shaft and to swingably insert the other end of the duct into the collection chamber, whereby the above-mentioned apparatus has a simple structure, operates practically without trouble and can recover minerals from the bottom of the water.

14 Claims, 11 Drawing Figures

APPARATUS FOR RECOVERING MINERALS, IN PARTICULAR MANGANESE NODULES, FROM THE BOTTOM OF THE WATER

BACKGROUND OF THE INVENTION

1. Field of the Invention

The present invention relates to an apparatus for recovering minerals from the bottom of the water, in particular manganese nodules from the ocean floor.

2. Description of the Prior Art

Manganese nodules exist in a muddy surface layer on the bottom of the deep sea and the size of the nodules varries from a pebble size to a first size. As the manganese nodules are found in the depth of several thousands metres from the surface of the sea, it is the most efficient that the manganese nodules are continuously transported to a mining ship to recover them. There has been proposed a continuous transportation method wherein a stream of the sea water is formed in a pipe toward the surface of the sea and minerals are transported together with this stream.

However, it requires a considerable time to bring down the recovering apparatus in the deep bottom of the water and to pull up it therefrom. Therefore, when the apparatus gets out of order in the water, the recovering time is greatly wasted because the apparatus must be pulled up and then brought down again.

SUMMARY OF THE INVENTION

An object of the present invention is to provide an apparatus for recovering minerals from the bottom of the water which has only a few mechanical moving parts and operates almost without trouble.

Another object of the present invention is to provide an apparatus which permits to selectively and efficiently recover minerals having a desired size from the bottom of the water without either blocking up the above-mentioned transportation pipe with the minerals or bringing in it the mud not wanted together with the minerals.

In accordance with the present invention, an apparatus for recovering minerals from the bottom of the water comprises a frame which is almost rectangular and has slide bodies on the bottom surface thereof, and at least one mineral floating apparatus which is universally rotatably supported on the frame at an end thereof and is inserted the other end into a side opening of a collection chamber fixed to the frame, said mineral floating apparatus having the bottom surface projected from the bottom surface of the frame, and being integrally constructed with a cylindrical surface member accommodated therewithin, a nozzle provided in adjacent to the outside of the cylindrical surface member for jetting the water along the bottom surface of the mineral floating apparatus and a duct opened to both sides of the downstream of the water jetted from the nozzle and of the collection chamber, respectively, and provided at an angle, said collection chamber being connected to a suction pipe.

DETAILED DESCRIPTION OF PREFERRED EMBODIMENTS

Figure 9:
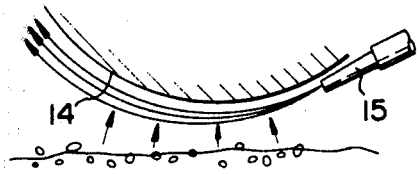
FIG. 9 is a view for explaining principles employed in the main parts of the apparatus according to the present invention.

As shown in FIG. 9, when the water is jetted from a nozzle 15 in contact with a cylindrical surface 14 in the direction of a tangent which is at a right angle to the center axis of the cylindrical surface 14, the jet velocity v is represented by the formula $$v = \sqrt{2gh}$$

wherein $v$ is the water jet velocity from the nozzle 15 in m/sec., $g$ is the acceleration of gravity 9.8m/sec.$^2$ and $h$ is an environmental pressure in m of the water column (in atmospheric pressure $v \approx$ 14m/sec. and at the bottom of the deep sea of 5,000m $v \approx$ 313m/sec.). Jetting the water at a lower velocity than this jet velocity, the water flows along the cylindrical surface 14 to cause a suction force toward the cylindrical surface 14.

The apparatus for recovering minerals from the bottom of the water in accordance with the present invention is based on the above mentioned principle.

The apparatus according to the present invention mainly comprises a frame 1, a pump 2, a driving device 3 for the pump 2, a collection chamber 4, a plurality of mineral floating apparatus 5 (three in the example shown in the drawings) and a suction pipe 6. The frame 1 is formed as a rectangular frame comprising longer sides 1*a*, 1*b* and shorter sides 1*c* and 1*d*, and is integrally provided with sleds 7 under the longer sides 1*a*, 1*b* in parallel with the longer sides 1*a*, 1*b*, said sleds 7 being so formed that it can be travelled by dragging in contact with the bottom of the water in the longitudinal direction.

On the frame 1, the pump 2 and the driving device 3 for driving the pump 2, for example, an electrical motor or a fluid motor are supported on a base 8 whose both ends are supported between the central parts of the longer sides 1*a*, 1*b*. A collection chamber 4 is formed near at the shorter side 1*c* at a right angle to the frame 1*a*. The upper part of the collection chamber 4 is made from nets 9 for the side walls near the shorter side 1*c* and top peripheral walls, and is provided with a window 10 on the peripheral wall faced to the shorter side 1*d*. In the interior of the collection chamber 4, a grating 11 is provided diagonally in the direction from the shorter side 1*c* to the shorter side 1*d* to divide the chamber practically upper and lower parts, and it is extended out from the lower edge of the window 10. A mesh of the net 9 is so selected that it passes through minerals with a size which is smaller than a lower-limit size of the mineral desired to recover, and the grating 11 is so arranged that it has a mesh which permits to pass through the mineral with an upper-limit size desired to collect but not to pass through the mineral with a greater size than that.

The bottom of the collection chamber 4 is coupled to a suction pipe 6 connecting to the interior of the chamber 4. An end of the suction pipe 6 is fixed to the frame 1 and the other end thereof extends to the mixing ship on the surface of the sea. The bottom 12 of the collection chamber 4 is gradually slanted down from the side of the longer side 1*a* to the side of the longer side 1*b* and is provided with a screw 13 for sending away downwards the minerals fallen on the bottom 12. The lowest part of the bottom 12 is connected to the pipe 6 (see FIG. 5).

Each mineral floating apparatus 5 is integrally constructed with a cylindrical surface 14, a nozzle 15 which is provided along the outside of the cylindrical surface 14 and jets the water along the bottom surface 5*a* of the mineral floating apparatus 5 in the direction of a tangent at a right angle to a center axis of the cylindrical surface 14, ribs 16 which project outside of the cylindrical surface 14, extend to the jet direction of the nozzle 15, and are provided on the bottom surface of the mineral floating apparatus along the outside of the nozzle 15, and a duct which has an opening at one end of the duct at the downstream of the water jetted from the nozzle 15 and extends slopewise in tangent with a part of the cylindrical surface 14 so as to receive the water moved along the outside of the cylindrical surface 14.

On the frame 1 near the shorter side 1*d* from the center, a supporting shaft 18 is so disposed that both ends thereof are supported on the longer sides 1*a,* 1*b,* and it is parallel to a line typing the bottom surfaces of the two parallel sleds 7 and is at a right angle to the longer sides 1*a,* 1*b.* The mineral floating apparatus 5 is so arranged that the side of the cylindrical surface 14 having nozzle 15 and ribs 16 exposes to the bottom surface of the frame 1 between the sledes 7, 7, and the jet direction from the nozzle 15 and the direction of the base line of the cylindrical surface 14 go almost parallel to the bottom surface of the frame 1, and the cylindrical surface 14 is accommodated within the mineral floating apparatus 5 so as to project the ribs 16 outside of the bottom. Said mineral floating apparatus 5 is also supported at the opposite side of the duct 17 by the supporting shaft 18 so as to be able to rotate the side of the duct 17 around the shaft 18 and to swingably insert the other end of the duct 17 into the window 10 of the collection chamber 4.

Further, the frame 1 is provided with a water taking-in pipe 19, an end thereof being connected to the intake of the pump 2, and the other end extending and opening to the shorter side 1*d.* The exhaust port of the pump 2 is connected to a distributing tube 20. The distributing tube 20 is connected by means of flexible hoses 21 to each nozzle 15 of the mineral floating apparatus 5 disposed to the supporting shaft 18 at a right angle respectively.

When the apparatus is lowered on the bottom of the sea to contact the sleds 7 with the bottom of the sea, the mineral floating apparatus 5 will be kept in such a state that the ribs 16 are in contact with the bottom of the sea and the exits of the nozzles 15 and the cylindrical surface 14 is apart from the bottom of the sea at a suitable distance. Thereafter, the driving device 3 is drived, for example, by applying an electric current to an electric wire (not shown in the drawings) extending from the driving device to the mining ship on the surface of the sea, the water is supplied from the pump 2 to the nozzles 15 and the water is jetted at a rate lower than the limited velocity mentioned above. The water jetted from the nozzles 15 flows along the cylindrical surface 14 and floats the minerals on the bottom of the sea to introduced into the duct 17 together with the water jetted from the nozzles 15.

Thereat, an auxiliary nozzle 22 may be provided at the inlet of the duct 17 to jet the water toward the inside of the duct 17 and promote the introduction of the minerals into the duct 17. When an amount of the water jetted from the nozzle 15 is 70–80 parts per unit time, it is preferable to jet the water from the auxiliary nozzle 22 in an amount of 30–20 parts per unit time.

Driving the pump 2 and a pump which is mounted on the mining ship on the surface of the sea at the same time and sucking off the water by way of the suction pipe 6 upward the mining ship, the minerals introduced into the collection chamber through the duct 17 together with the water can be transported to the mining ship. The minerals transported with water up to the mining ship is separated from water and taken into the ship but the water is discharged in the sea.

Provided that the internal dimensions of the duct 17 and the internal diameter of the suction pipe 6 are so large that they permit to recover even the largest minerals on the bottom of the sea, all the side of the collection chamber 4 except for the window 10 may be formed with walls completely dividing the inside and outside of the chamber. However, the peripheral walls of the upper part of the collection chamber are formed with net 9 as shown in the drawings, whereby the mud of the bottom of the sea introduced into the collection chamber 4 together with the smaller minerals and the water can be exhausted through the mesh of the net 9. Then the larger minerals not passing through the net 9 are on the grating 11, the greater minerals than the slit of the grating 11 are discharged out from the window 10 and only the minerals which pass through the grating 11 are transported through the suction pipe 6 to the surface of the sea and recovered.

Accordingly, the minerals having a range of size desired can be recovered by selecting suitable mesh and slit sizes of the net 9 and the grating 11 and thereby the trouble wherein the suction pipe 6 is blocked with the minerals can be avoided.

Figure 5:
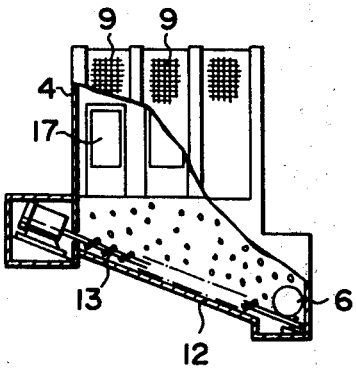
FIG. 5 is a sectional view taken along line V—V of FIG. 2.
Figure 6:
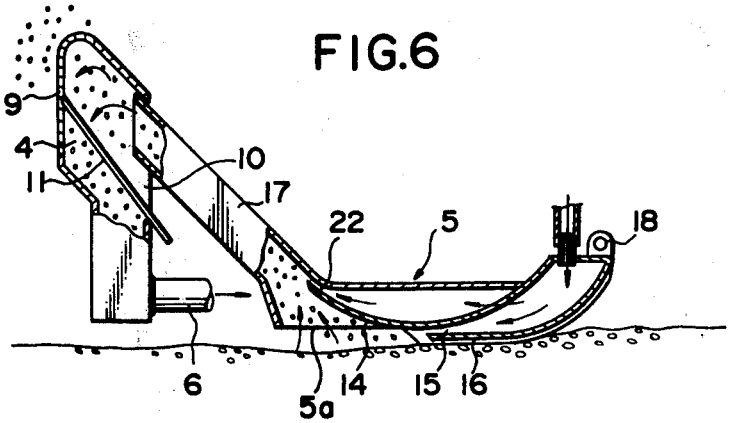
FIG. 6 is a sectional view taken along line VI—VI of FIG. 1 showing a collector and a mineral floating apparatus.
Figure 5A:
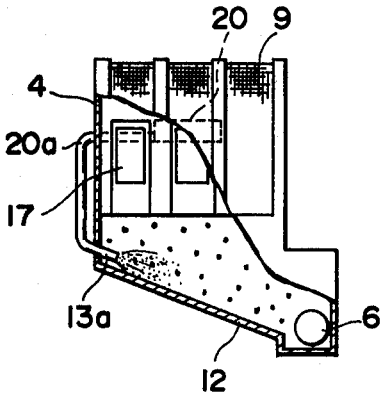
FIG. 5A is a sectional view similar to FIG. 5 and showing a modification of FIG. 5.
Figure 5B:
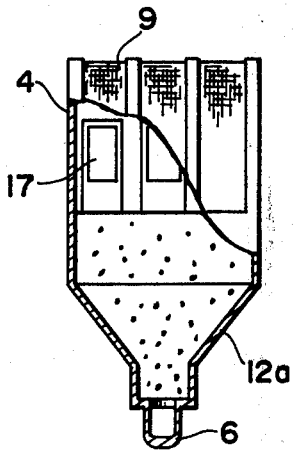
FIG. 5B is a sectional view showing another modification of FIG. 5.
Figure 7:
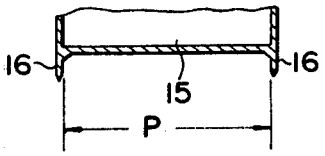
FIG. 7 is a sectional view taken along line VII—VII of FIG. 2.

As shown in FIG. 5, the minerals dropped on the bottom 12 of the collection chamber 4 is sent away to the fitting part of the suction pipe 6 by the screw 13. Alternatively, as shown in FIG. 5A, the bottom 12 of the collection chamber 4 is slanted in the direction chamber 4 is slanted in the direction at a right angle with the longer sides 1a, 1b of the apparatus and the lower end of a pipe 20a connected to the distributing tube 20 is fitted to the upper part of the slanted bottom surface of the collection chamber to form the above-mentioned lower end as a nozzle 13*a* so that the minerals on the bottom surface may be sent away to the suction pipe 6 by the action of a jet stream from the nozzle 13*a.* Still alternatively, as shown in FIG. 5B, the bottom of the collection chamber may be in the form of a funnel 12*a* so that the similar function may be provided.

Figure 1:
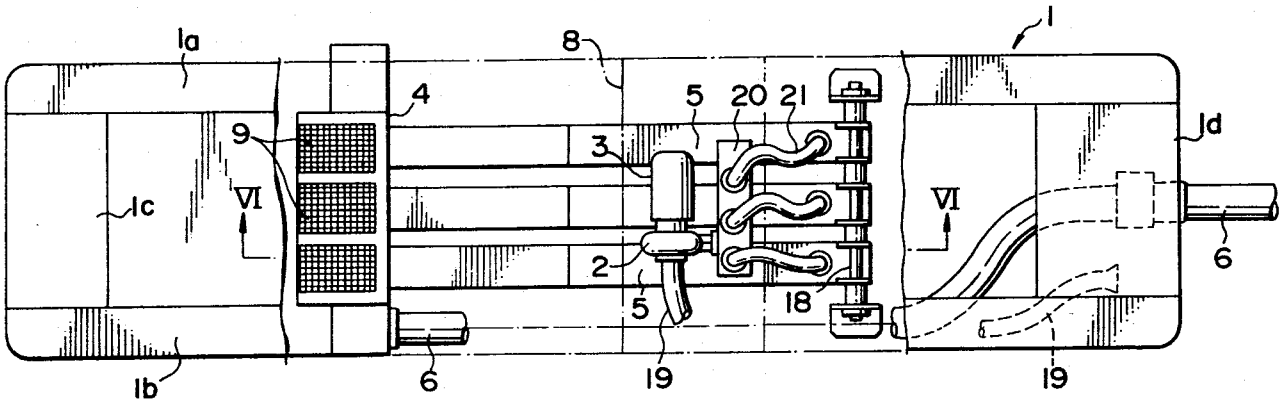
FIG. 1 is a plan view of an embodiment of an apparatus according to the present invention.
Figure 2:
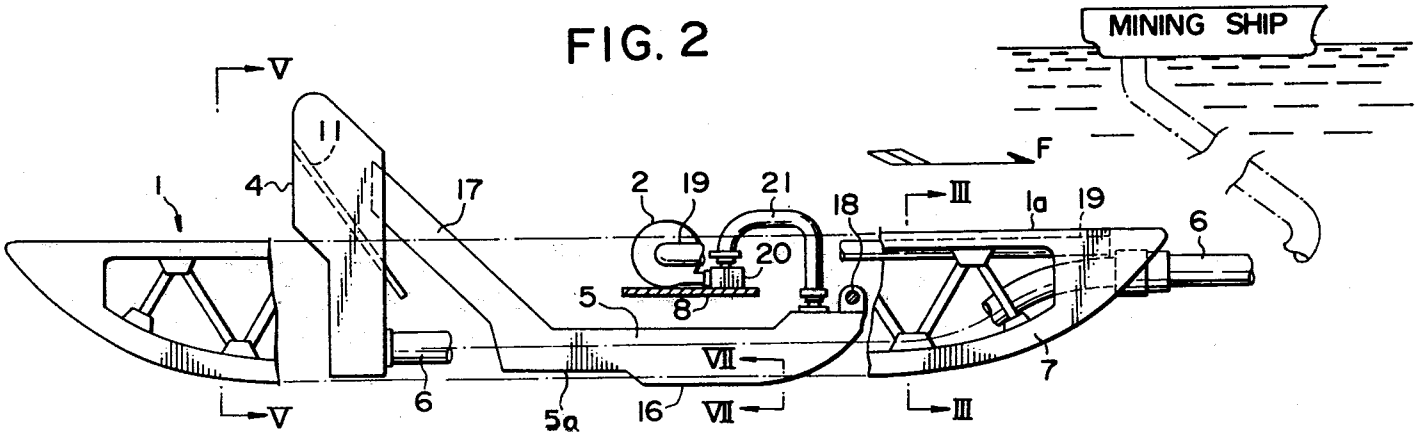
FIG. 2 is a side view of FIG. 1.
Figure 3:
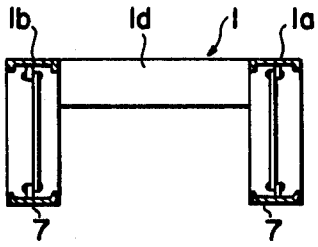
FIG. 3 is a sectional view taken along line III—III of FIG. 2.
Figure 4:
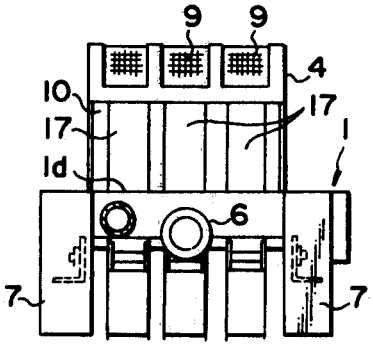
FIG. 4 is a right front view of FIG. 1.
Figure 8:
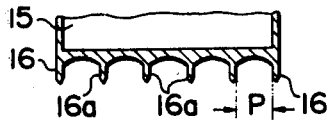
FIG. 8 is a sectional view of another embodiment of FIG. 7.

The frame 1 is travelled on the bottom of the sea in the direction of the arrow head F shown in the FIG. 2 parallel to the lower sides 1*a,* 1*b* by means of the suction pipe 6 or otherwise a rope coupling the frame 1 to the mining ship by sailing the mining ship. Thereat because the each mineral floating apparatus 5 is so formed that it can be independently swung around the supporting shaft 18 supported on the frame 1, the duct 17 is moved up and down in accordance with the irregularity of the bottom of the sea to make the jet direction of the nozzle 15 parallel to the bottom surface of the sea, thereby the minerals can be recovered effectively. As shown in FIG. 8, when a plurality of ribs 16*a* are further provided between the ribs 16 along the jet direction of the nozzle 15 at an equal distance in the same form as the ribs 16 and the pitches P among ribs are equal to the maximum size of the minerals desired to recover, then the larger minerals than the size desired to recover are pressed on the bottom surface of the sea and becomes difficult to float off because the ribs 16 travel in contact with the bottom of the sea. Therefore it can be reduced that the duct takes in the larger minerals than the size desired to recover.

In the apparatus of the present invention the collection chamber 4 is advantageously constructed when the duct 17 is formed at an angle of more than 30°, preferably 35°–70° to the jet direction from the nozzle 15. The apparatus of the present invention can be formed in such a specification that a width of the frame 1 is 0.4–4m, a diameter of the cylindrical surface 14 is 0.2–1m, a travel rate of the frame 1 is 0.5m/sec., a jet velocity of the nozzle 15 is 1–32m/sec. at the bottom of the deep sea of 5,000m in the relative velocity to the sea bottom, a width of the mineral floating apparatus 5 is 0.5–4m, a mesh size of the net 9 is 3–10mm and a slit size of the grating 11 is 50–100mm.

Having thus described a preferred example of the present invention, the apparatus in accordance with the present invention operates almost without trouble, because the apparatus can be constructed in a very simple structure having only a few mechanical moving parts, as the case may be all system of the apparatus can be operated by only one pump. Further, with the present apparatus the transportation to the surface of the sea can be carried out efficiently, because the minerals having the desired size can be recovered and separated from the mud of the sea bottom by the jet water. Furthermore, the present apparatus can be placed stably on the bottom surface of the sea because a plurality of mineral floating apparatus can be moved up and down in accordance with the irregularity of the sea bottom.

I claim:

1. An apparatus for recovering minerals from the bottom of the water comprising a frame which is almost rectangular and has slide bodies on the bottom surface thereof, and at least one mineral floating means which is universally rotatably supported on the frame at an end thereof and is inserted the other end into a side opening of a collection chamber fixed to the frame, and said mineral floating means having the bottom surface projected from the bottom surface of the frame and being integrally constructed with a cylindrical surface member accommodated therewithin, a nozzle provided in adjacent with the outside of the cylindrical surface member for jetting the water along the bottom surface of said mineral floating means and a duct opened to both ends of the downstream of the water jetted from the nozzle and of the collection chamber, respectively, and provided at an angle, said collection chamber being connected to a suction pipe.

2. The apparatus according to claim 1 wherein said collection chamber comprises a net provided on the peripheral wall of said collection chamber and a grating having a slit greater than mesh of the net, said grating being so provided under said duct diagonally in an angle that said collection chamber is divided practically into upper and lower parts, an end of said grating being projected out from said side opening, and said suction pipe is connected with said collection chamber at the lower part of said grating.

3. The apparatus according to claim 1 wherein said mineral floating means is further provided at least two parallel ribs on the bottom surface thereof.

4. The apparatus according to claim 3 wherein the width of spaces between said ribs are equal to a maximum size of minerals desired to recover.

5. The apparatus according to claim 1 wherein an angle of said duct to the jet direction from the nozzle is at least 30°.

6. The apparatus according to claim 5 wherein said angle is 35° to 70°.

7. The apparatus according to claim 1 wherein the bottom surface of said collection chamber is slanted to the direction which is at a right angle to the longitude of the apparatus, said slanted bottom surface is provided with a screw for sending away the minerals and the suction pipe is connected to the lowest part of said bottom surface.

8. The apparatus according to claim 1 wherein an auxiliary nozzle is provided parallel to said nozzle and a ratio of the jet water amount of the nozzle to the jet water amount of the auxiliary nozzle is 70–80: 30–20.

9. The apparatus according to claim 1 wherein a water jet velocity V from said nozzle is $$V < \sqrt{2gh}$$

wherein $g$ is the acceleration of gravity and h is an environmental pressure in water column.

10. The apparatus according to claim 1 wherein an upper end of said suction pipe is connected with a mining ship.

11. The apparatus according to claim 1 wherein the bottom surface of said collection chamber is slanted in the direction at a right angle with the longer sides of the apparatus, a means for sending away the minerals by a jet stream is provided at the upper part of said slanted bottom surface and the suction pipe is connected to the lowest part of said bottom surface.

12. The apparatus according to claim 1 wherein the bottom surface of said collection chamber is in the form of a funnel and the suction pipe is connected to the lowest part of said funnel.

13. The apparatus according to claim 1 wherein the radius of said cylindrical surface member is 0.2 to 1m.

14. An apparatus for recovering minerals from the bottom of the water comprising a frame carrying a pump for sucking water and feeding it to a nozzle, driving device for said pump, a collection chamber, a mineral floating apparatus equipped therein with said nozzle and a suction pipe communicating to said collection chamber, wherein an end of said suction pipe is fixed to said frame, said frame being so formed that it can travel on the bottom of the water, said mineral floating apparatus being formed integrally with a cylindrical surface, the above mentioned nozzle provided along the outer periphery of said cylindrical surface and jetting water in the tangential direction at a right angle with a center axis of said cylindrical surface and in substantially parallel direction to the bottom surface of said frame, ribs protrudently formed in the opposite direction to the side of said cylindrical surface and an inclined duct extending in the tangential direction with a part of said cylindrical surface and having an opened end at the downstream of the water jetted from said nozzle so as to receive the water flowing along the outer periphery of said cylindrical surface, and said mineral floating apparatus being pivoted at the front side thereof by a supporting shaft so as to enable said ribs to be at a position lower than the bottom of said frame and enable to move the rear side thereof upwardly and downwardly, another end of said duct being inserted in said collection chamber to be swingably moved therein.

* * * * *